US010046374B2

(12) United States Patent
Pachla et al.

(10) Patent No.: US 10,046,374 B2
(45) Date of Patent: Aug. 14, 2018

(54) METHOD OF PRODUCING HIGH-STRENGTH RODS OF AUSTENITIC STEEL AND A ROD PRODUCED BY SUCH METHOD

(71) Applicant: INSTYTUT WYSOKICH CISNIEN POLSKIEJ AKADEMII NAUK, Warsaw (PL)

(72) Inventors: Waclaw Pachla, Warsaw (PL); Mariusz Kulczyk, Warsaw (PL); Jacek Skiba, Radom (PL); Konrad Wojciechowski, Celestynów (PL)

(73) Assignee: INSTYTUT WYSOKICH CISNIEN POLSKIEJ AKADEMII NAUK, Warszawa (PL)

( * ) Notice: Subject to any disclaimer, the term of this patent is extended or adjusted under 35 U.S.C. 154(b) by 774 days.

(21) Appl. No.: 14/414,522

(22) PCT Filed: Jul. 13, 2013

(86) PCT No.: PCT/PL2013/050018
§ 371 (c)(1),
(2) Date: Jan. 13, 2015

(87) PCT Pub. No.: WO2014/011067
PCT Pub. Date: Jan. 16, 2014

(65) Prior Publication Data

US 2015/0190856 A1 Jul. 9, 2015

(30) Foreign Application Priority Data

Jul. 13, 2012 (PL) ..... 399967

(51) Int. Cl.
*C22C 38/18* (2006.01)
*C22C 38/40* (2006.01)
(Continued)

(52) U.S. Cl.
CPC ..... *B21C 37/045* (2013.01); *B21C 23/002* (2013.01); *B21C 23/007* (2013.01);
(Continued)

(58) Field of Classification Search
CPC ..... B21C 37/045; B21C 23/007; C22C 38/50; C22C 38/58; C22C 38/44; C22C 38/42
See application file for complete search history.

(56) References Cited

U.S. PATENT DOCUMENTS 524,504 A 8/1894 Robertson
5,904,062 A 5/1999 Semiatin et al.

FOREIGN PATENT DOCUMENTS

GB 1384 738 A 2/1975
JP 62-290848 * 12/1987

OTHER PUBLICATIONS

English Abstract of Kawauchi et al. (JP 62-290848) (dated Dec. 17, 1987).*

(Continued)

*Primary Examiner* — Jessee Roe
(74) *Attorney, Agent, or Firm* — Horst M. Kasper, Esq.

(57) ABSTRACT

Rods with the transverse cross-section surface area of at least 150 $mm^2$ and tensile strength UTS above 1200 Mpa is produced using a plastic deformation that consisted of one-pass hydrostatic extrusion of the billet 1 made of austenitic steel, with the initial temperature of the billet being below 100° C. The reduction R of the transverse cross-section surface area of the biller (1), which takes place during the extrusion, is at least 2.

7 Claims, 2 Drawing Sheets

(51) Int. Cl.

| | |
|---|---|
| ***C21D 7/02*** | (2006.01) |
| ***C21D 7/10*** | (2006.01) |
| ***B21C 23/00*** | (2006.01) |
| ***B21C 37/04*** | (2006.01) |
| ***C22C 38/00*** | (2006.01) |
| ***C22C 38/02*** | (2006.01) |
| ***C22C 38/04*** | (2006.01) |
| ***C22C 38/44*** | (2006.01) |
| ***C22C 38/42*** | (2006.01) |
| ***C22C 38/50*** | (2006.01) |
| ***C22C 38/58*** | (2006.01) |
| *C21D 6/00* | (2006.01) |

(52) U.S. Cl.

CPC ..... *C21D 7/10* (2013.01); *C22C 38/00* (2013.01); *C22C 38/001* (2013.01); *C22C 38/02* (2013.01); *C22C 38/04* (2013.01); *C22C 38/42* (2013.01); *C22C 38/44* (2013.01); *C22C 38/50* (2013.01); *C22C 38/58* (2013.01); *C21D 6/004* (2013.01)

(56) References Cited

OTHER PUBLICATIONS

J. Budniak, M. Lewandowska, W. Pachla, M. Kulczyk, K. J. Kurzydlowski, "The Influence of Hydrostatic Extrusion on the Properties of an Austenitic Stainless Steel", Solid Statr Phenomena 2006 vol. 114, pp. 57-62. Paper Title: The Influence of Hydrostatic Extrusion on the Properties of an Austenitic Stainless Steel.

Characterization of the effects of hydrostatic extrusion on grain size, suface composition and the corrosion resistance of austenitic stainless steels.

Low temperature mechanical properties of 316L type stainless steel after hydrostatic extrusion.

Pisarek M et al: „Effect of Hydrostatic Extrusion on The Corrosion Resistance of Type 316 Stainless Steel, Corrosion, Nace International, Houston, TX; US, US. vol. 64, No. 2, Feb. 1, 2008 (Feb. 1, 2008), pp. 131-137 XP001511553, ISSN: 0010-9312 pp. 131-133.

* cited by examiner

METHOD OF PRODUCING HIGH-STRENGTH RODS OF AUSTENITIC STEEL AND A ROD PRODUCED BY SUCH METHOD

TECHNICAL FIELD

The invention relates to a method of producing rods of austenitic steel with a cross-section surface area at least 150 $mm^2$ and the tensile strength higher than 1200 MPa, as well as a rod with these properties.

BACKGROUND ART

Commonly known methods of producing thick steel rods, resistant to corrosion, with the cross-section surface area above 150 $mm^2$ i.e. with the diameter of 14 mm, which are based on the expensive modification of the chemical composition of the steel followed by a plastic treatment such as e.g. forging do not permit achieving in these rods the tensile strength UTS above 1000 MPa and the yield stress YS above 900 MPa. There have also been known wires with high strength UTS>1000 MPa, but they have been produced by multiple-pass drawing, a technology which in common opinion cannot however yield thick rods.

The plastic treatment method called the hydrostatic extrusion has been known since over one hundred years (U.S. Pat. No. 524,504). In this method the billet (the material to be extruded) is placed in a high-pressure chamber filled with a pressure transmitting medium. The high-pressure chamber is closed from one side with a piston and from the other side with a die which is shaped adequately to the desired shape of the final product. When moving into the depth of the chamber, the piston compresses the pressure transmitting medium thereby increasing the hydrostatic pressure in the chamber. After the critical pressure, characteristic of the billet material, is reached, the billet begins to be extruded through the die to form the desired product. One of the important parameters of the hydrostatic extrusion process is what is known as the reduction R which describes the degree of reduction of the transverse cross-section of the billet and is defined as the ratio of the billet cross-section surface area before the extrusion to that of the product after the extrusion. Since the beginning of experiments with the hydrostatic extrusion process, there have been many literature reports describing the use of this method for treating various metals, alloys, composites, plastics, and other materials, but, on the industrial scale, it has never been used for hydrostatically extruding steel. The hydrostatic extrusion process was however investigated for experimental purposes and described by J. Budniak, M. Lewandowska, W. Pachla, M. Kulczyk, K. J. Kurzydtowski in "*The influence of hydrostatic extrusion on the properties of austenitic stainless steel*" [Solid State Phenomena 2006, Vol 114, pp 57-62]. The results reported in this publication concern rods with mechanical strength UTS>1200 MPa but with small diameters (below 6 mm). The rods were extruded using the cumulative method (a multi-pass process) with the reduction in one pass not exceeding 2. Neither was examined the effect of the hydrostatic extrusion of steel on the distribution of the mechanical properties on a transverse cross-section of the rods obtained. M. Pisarek, P. Kędzierzawski, T. Plociński, M. Janik-Czachor, K. J. Kurzydtowski in "*Characterization of the Effects of Hydrostatic Extrusion on Grain Size, Surface composition and the Corrosion Resistance of Austenitic Stainless Steels*" [Materials Characterization, 59, 9 (2009) 1292-1300] describe the results of their studies on the corrosion and other surface properties of hydrostatically extruded austenitic steel, but their experiments only included rods with small diameters, produced by the accumulation of several extrusion passes, each with a low cross-section reduction. The paper "*Low-temperature mechanical properties of* 316*L type steel after hydrostatic extrusion*" [Original Research Article Fusion Engineering and Design, Volume 86, Issues 9-11, October 2011, Pages 2517-2521] by P. Czarkowski, A. T. Krawczyńska, R. Slesiński, T. Brynk, J. Budniak, M. Lewandowska, K. J. Kurzydtowski presents the results of investigating the mechanical properties of austenitic steel subjected to hydrostatic extrusion at a low temperature, but this publication is only concerned with products of small diameters (up to 6 mm) produced in the cumulative way with a low one-pass reduction. In the available literature one cannot even find speculative opinions concerning the possibility of hydrostatic extrusion of steel conducted with a high reduction degree in one pass, or the possibility of using this technology with an arbitrarily high reduction degree, or else its use for the fabrication of steel rods with greater diameters.

DISCLOSURE OF INVENTION

The aim of the invention was to develop a technology of the rods made of corrosion-resistant steel, which have a large transverse cross-section surface area and strength parameters that were thus far only achieved in wires and rods with small diameters.

This aim is achieved by using a strain-hardening due to plastic deformation of austenitic steel which is realized by one-pass hydrostatic extrusion applied to the billet made of austenitic steel, with the billet having the initial temperature below 100° C. The reduction of the transverse cross-section surface area of the billet takes place during its extrusion is at least 2.

In one of embodiments of the method according to the invention the temperature of the billet to be subjected to hydrostatic extrusion is equal to room temperature. In next embodiment of the method according to the invention the reduction of the transverse cross-section surface area of the billet, which occurs during the hydrostatic extrusion, falls within the range from 2 to 2.56.

In next embodiment of the method according to the invention the billet subjected to hydrostatic extrusion is made of steel whose chemical composition, expressed in weight percents, is: below 0.1% of carbon, below 1% of silicon, below 2% of manganese, below 0.05 of phosphorus, below 0.03 of sulphur, from 15% to 20% of chromium, below 3% of molybdenum, from 8% to 19% of nickel, below 2% of copper, below 0.8% of titanium, below 0.22% of nitrogen, and iron and other unavoidable impurities balance.

In next embodiment of the method according to the invention hydrostatic extrusion of the billet is conducted at a constant linear speed.

In another embodiment of the method according to the invention, the pressure of the pressure transmitting medium which extrudes the billet is not below 600 MPa. In yet another embodiment of the method according to the invention, prior to the beginning of the hydrostatic extrusion process, the billet is covered with a copper-based lubricant.

A rod according to the invention is characterized by that it has been produced according to the above described method.

The principal advantage of the method according to the invention is the possibility of producing, in a simple and inexpensive manner, a product resistant to corrosion and with so good mechanical properties that are unavailable in the market. An additional advantage of the invention is that, thanks to the availability of the material with high mechanical strength produced according to the present invention, we can reduce the weight of a given construction by using components of lower weight but, at the same time, stronger than conventional components.

BRIEF DESCRIPTION OF DRAWINGS

The invention has been illustrated in the enclosed figures of drawing, in which.

MODE FOR CARRYING OUT INVENTION

Below has been described the hydrostatic extrusion of three exemplary rods made of austenitic steel using the technology according to the present invention:

EXAMPLE 1

Figure 1:
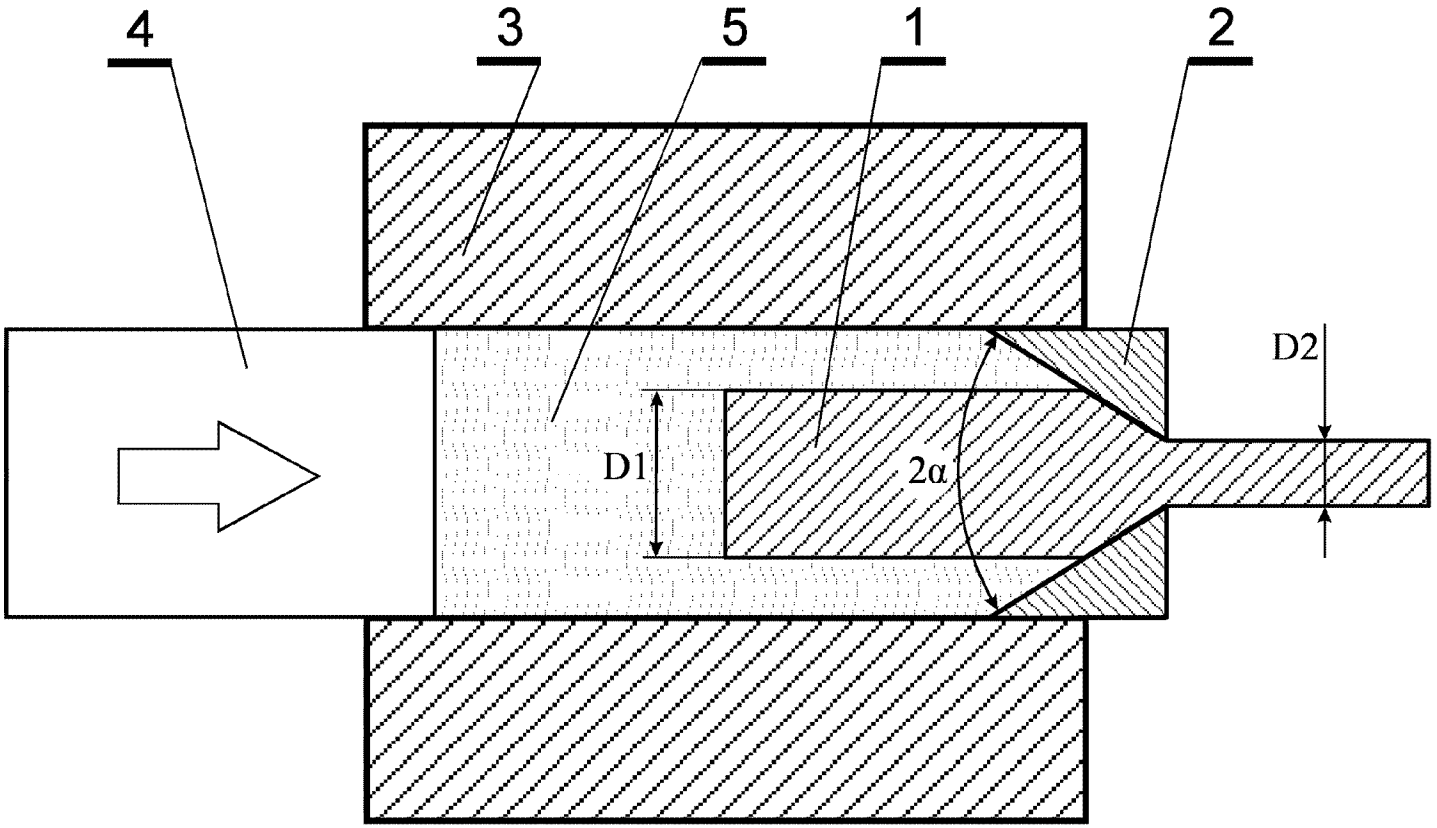
FIG. 1 is a schematic representation of the hydrostatic extrusion process and apparatus.

Austenitic steel of the 316L type whose chemical composition, expressed in weight percents, is: below 0.03% of carbon, below 1% of silicon, below 0.2% manganese, below 0.045% of phosphorus, below 0.015% of sulphur, from 16.5% to 18.5% of chromium, from 2% to 2.5% of molybdenum, from 10% to 13% of nickel, below 0.011% of nitrogen, and iron and unavoidable impurities balance, was subjected to hydrostatic extrusion at room temperature with the reduction R=2.31 Billet 1 made of the above described steel had the form of a cylinder with the diameter D1=38 mm and 300 mm long, ended at one side with a cone with the apex angle 2α=45° that was fitted to the angle of the die (2). After covering the billet 1 with a copper-based CS-90 lubricant, it was placed in the high-pressure chamber 3 of the extruding apparatus, with the conical end of the billet 1 being inserted into the hollow of the die 2 with the exit diameter of 25 mm. The high-pressure chamber 3 was closed with the piston 4 and filled with a known pressure transmitting medium 5. The increase of pressure in the chamber 3 was due to the uniform motion of the piston 4 in the direction indicated by the arrow in FIG. 1. Once the pressure in the chamber 3 reached the critical value of 970 MPa, the extrusion process began resulting in a rod with the nominal diameter D2=25 mm being produced during a single extrusion pass. The rod thus obtained had the tensile strength UTS=1280 MPa and the yield stress YS=1100 MPa and was elongated by 15%.

EXAMPLE 2

The steel, as described in Example 1, was subjected to hydrostatic extrusion conducted at room temperature with the reduction R=2.56 in the same apparatus as in Example 1. The billet 1 had the shape of a cylinder with the diameter D1=40 mm and 300 mm long and ended at one side with a cone with the apex angle of 2α=90° fitted to the angle of the die 2. Billet 1 was covered with a copper-based CS-90 lubricant and then extruded hydrostatically, during a one-pass operation, to the diameter D2=25 mm. The rod thus obtained had the tensile strength UTS=1310 MPa and the yield stress YS=1200 MPa and was elongated by 14.5%.

EXAMPLE 3

The steel, as described in Example 1, was subjected to hydrostatic extrusion at room temperature with the reduction R=2.23 in the same apparatus as in examples 1 and 2, The billet 1 in the form of a cylinder with the diameter D1=37 mm and the length of 300 mm and ended at one side with a double cone with the apex angle 2 24° and α=90° fitted to the shape of the die 2. After the billet was covered with a molybdenum disulphide-based Molipas lubricant, it was extruded hydrostatically to the nominal diameter D2=25 mm during a one-pass operation. The austenitic steel of which the extruded rod was composed had the tensile strength UTS=1210 MPa and the yield stress YS=1140 MPa and was elongated by 18%.

Figure 2:
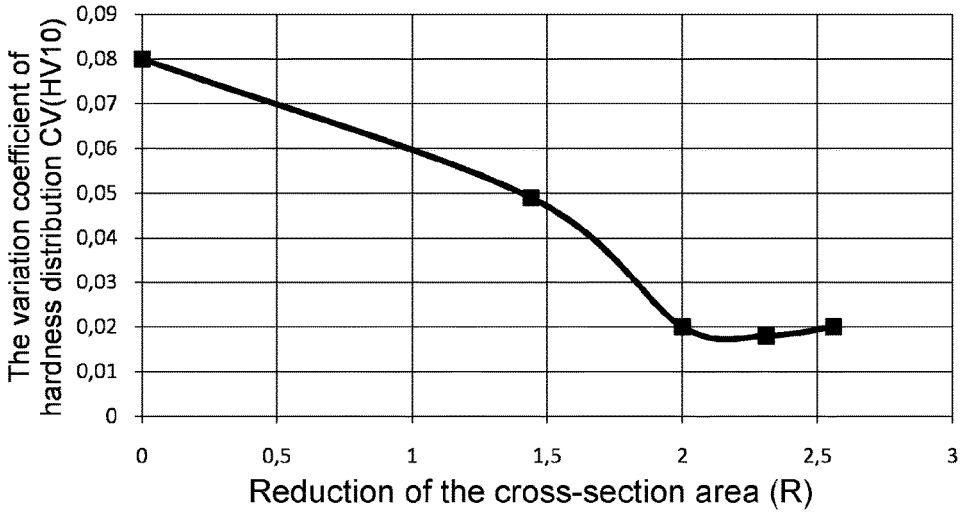
FIG. 2 shows profile the so-called of the variation coefficient of hardness distribution CV(HV10) as a function of the increasing reduction R, measured in austenitic steel after subjecting it to one-pass hydrostatic extrusions.
Figure 3:
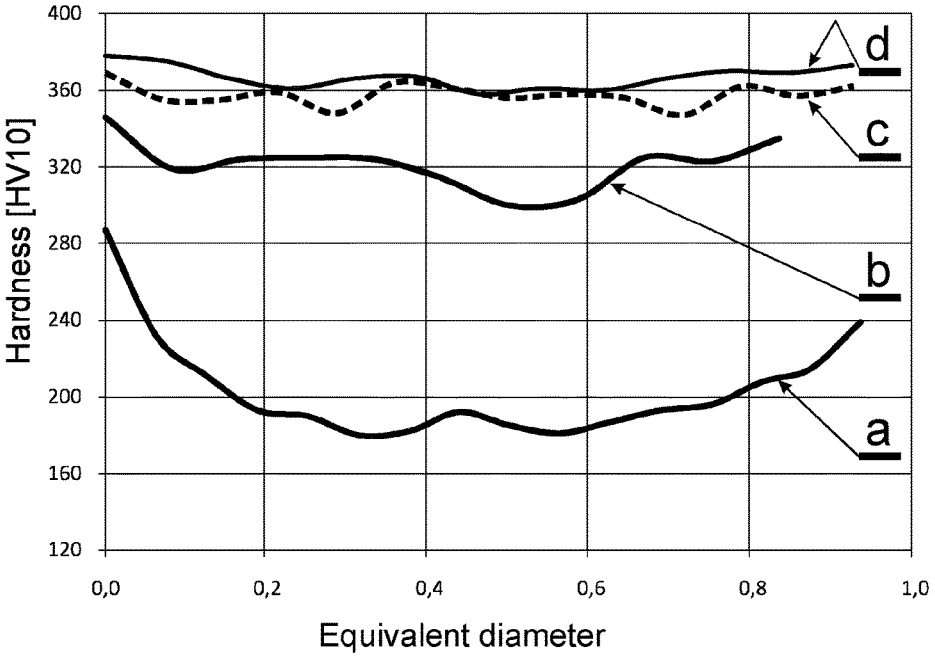
FIG. 3 shows profiles of the hardness distribution determined on a cross-section of the rod extruded hydrostatically with various reduction degrees.

The variation coefficient of hardness distribution CV(HV10), shown in FIG. 2, is defined as the ratio of the standard deviation to the average hardness value measured on a transverse cross-section of the extruded rod. As can be seen, the CVHV10 coefficient decreases with increasing reduction R. The character of the profile of this coefficient, which is a measure of the uniformity of the hardness distribution, plotted as a function of the reduction undergoes qualitative changes at the reduction 2. The considerable decrease of the CVHV10 coefficient (about 0.02) gives evidence of the uniformity of the microhardness distribution. Changes of this coefficient are visible in the measured hardness distribution profiles (FIG. 3) on a transverse cross-section of the extruded rod where we can see a well-marked "core" effect, characteristic of steel after subjecting it to forging, which vanishes with increasing reduction R. The curve (a) in the diagram represents the initial state of the billet material, the curve (b)—the rod hydrostatically extruded with the reduction R=1.44, the curve (c)—the rod extruded with R=2.31, and the curve (d)—the rod extruded with R=2.56. The one-pass hydrostatic extrusion with the reduction above 2 ensures a uniform deformation on the entire cross-section of the rod and, thus, guarantees that the properties of the product obtained will be homogeneous.

A typical commercial application of the rods according to the present invention is the fabrication of fasteners. For example, a screw M16 fabricated of a rod according to the invention can replace a screw M24 class 50 (UTS=500 MPa), which means that the mass of the screw will be decreased by more than a half while its high strength will be preserved.

The invention claimed is:

1. A method of producing rods of austenitic steel, having a surface area of a transverse cross-section equal to at least 150 $mm^2$ and the tensile strength (UTS) above 1200 MPa, using a plastic deformation characterized in that the plastic deformation consists of one-pass hydrostatic extrusion of a billet (1), made of austenitic steel and having a temperature lower than 100° C., with the reduction (R) of the transverse cross-section surface area of the billet (1), which takes place during the extrusion, being at least 2.

2. The method according to claim 1 wherein the temperature of the billet (1) subjected to hydrostatic extrusion is equal to room temperature.

3. The method according to claim 1, wherein the reduction (R) of the transverse cross-section surface area of the billet (1), which takes place during the hydrostatic extrusion, is from 2 to 2.56.

4. The method according to claim 1 , wherein the billet (1) subjected to hydrostatic extrusion is made of steel whose chemical composition, expressed in weight percents, is: below 0.1% of carbon, below 1% of silicon, below 2% of manganese, below 0.05 of phosphorus, below 0.03 of sulphur, from 15% to 20% of chromium, below 3% molybdenum, from 8% to 19% of nickel, below 2% of copper, below 0.8% of titanium, below 0.22% of nitrogen, and iron and unavoidable impurities—balance.

5. The method according to claim 1, wherein the hydrostatic extrusion of the billet (1) is conducted with a constant linear speed.

6. The method according to claim 1, wherein the pressure of the pressure transmitting medium (5) which extrudes the billet (1) is not lower than 600 MPa.

7. The method according to claim 1, wherein prior to the beginning of the hydrostatic extrusion process, the billet is covered with a copper-based lubricant.

* * * * *